US008225731B2

(12) United States Patent
Walker

(10) Patent No.: US 8,225,731 B2
(45) Date of Patent: Jul. 24, 2012

(54) MARINE THRUST WINGS

(76) Inventor: John G Walker, Lavrio (GR)

( * ) Notice: Subject to any disclaimer, the term of this patent is extended or adjusted under 35 U.S.C. 154(b) by 1286 days.

(21) Appl. No.: 11/889,760

(22) Filed: Aug. 16, 2007

(65) Prior Publication Data

US 2009/0044738 A1 Feb. 19, 2009

(51) Int. Cl.
*B63B 35/00* (2006.01)
*B64C 3/50* (2006.01)

(52) U.S. Cl. ..... 114/39.31; 244/214

(58) Field of Classification Search ..... 114/272, 114/273, 39.31; 244/45 R, 213, 214
See application file for complete search history.

(56) References Cited

U.S. PATENT DOCUMENTS 3,934,533 A * 1/1976 Wainwright ..... 114/39.31

FOREIGN PATENT DOCUMENTS

EP 0 061 291 9/1997
GB 2 263 892 8/1993

* cited by examiner

*Primary Examiner* — Lars A Olson
*Assistant Examiner* — Anthony Wiest
(74) *Attorney, Agent, or Firm* — Nixon & Vanderhye PC

(57) ABSTRACT

A wingsail assembly comprises a main symmetrical aerofoil which is freely rotatable about an upright axis and a control vane which is settable about an upright axis spaced from the axis of the main aerofoil to cause the main aerofoil to adopt an angle of attack to the direction of the wind. A pivoted aerodynamic slot-forming vane assembly is rotatable in response to wind pressure to open and close respective slots, one on each side of the leading region of the main aerofoil. A linkage inhibits movement of the slot-forming vane assembly away from a neutral position when the control vane is set to a neutral position.

11 Claims, 8 Drawing Sheets

MARINE THRUST WINGS

TECHNICAL FIELD

This invention relates to marine thrust wings. Such marine thrust wings are aerodynamic thrust devices broadly similar in principle to the wings of aircraft, but arranged upright (i.e. vertically) instead of horizontally, designed to propel and help to maneuver marine craft.

BACKGROUND

A typical design constraint, for marine craft other than certain specialized racing or record breaking boats, is that, unlike the wings of an aircraft, thrust wings must work as well with the wind coming from one side, or tack, as when it comes from the other side. In an aircraft, that is equivalent to the design of a plane capable of exactly the same performance upside down as right way up. In the specialized example of planes specifically designed for aerobatics, this is indeed sometimes the case.

This means that a thrust wing aerofoil section for marine use must be symmetrical about a vertical plane, or that it must be constructed from more or less vertical aerofoil components, each of which is symmetrical about its own vertical plane of symmetry, and each of which is hinged to another at the intersections of each plane of symmetry, so that any special arrangement of the components to increase thrust, or reduce drag, or both, on one tack may be recreated in a mirror image for sailing on the opposite tack.

Known examples include the wingsails fitted to the 'Zefyr' series of wingsail yachts. In this design a symmetrical wing is provided with a symmetrical external flap hinged to the wing at the intersection of their planes of symmetry. A third element, a symmetrical air directing slat, is also hinged to the wing at the intersection of their planes of symmetry. Careful selection of hinge axes and of the appropriate deflection angles of flap and slat can produce a deeply asymmetrical arrangement capable of extremely high levels of thrust at well-contained levels of drag, and also capable of being turned into its mirror image for sailing on the opposite tack.

However, the known wingsail has a relatively high level of complexity. For example, the flap is usually power operated by an electric or hydraulic actuator, and in some configurations a further flap locking system has been incorporated.

SUMMARY

The present invention is intended to provide a simpler and lower cost solution to the challenges of high-thrust, low-drag thrust wing design. It is based on a single symmetrical aerofoil fitted with a leading edge slat and slot arrangement which is composed of two parts. Powered systems will not be required to configure the wingsail components, which can be moved and maintained in place by the airstream alone.

In one aspect of the invention a wingsail assembly comprises a main wingsail aerofoil and a slot-forming vane assembly pivotally mounted forwardly of the leading edge of the main aerofoil, the vane assembly comprising a pair of lateral vanes positioned on opposite sides of the leading edge of the main aerofoil; and a central vane positioned between the lateral vanes and forwardly of the leading edge of the aerofoil, there being gap locations defined between each of the lateral vanes and the aerofoil and between each of the lateral vanes and the central vane. The vanes are mounted and pivoted such that deflection of the main aerofoil to an angle of attack with respect to the wind allows wind pressure to move the vanes so the leeward lateral vane is moved away from the main aerofoil thereby enlarging its respective gap with respect to the main aerofoil and so that the central vane is moved towards the leeward lateral vane to close that respective gap and enlarge the gap between the central vane and the windward lateral vane.

The lateral vanes may be mounted on a carrier which has a pivot axis spaced from and fixed parallel relative to a rotary axis of the main aerofoil, the carrier defining a pivot axis for the central vane and the central vane having a pivot connection with the main aerofoil.

In another aspect of the invention a wingsail assembly comprises a main aerofoil rotatable about an upright axis and a slot-forming vane assembly, the vane assembly comprising a pair of lateral vanes and a central vane disposed along a curve spaced from and extending at least part way around the leading edge of the main aerofoil, the central vane being movable along the curve with respect to the lateral vanes to correspondingly enlarge or decrease gaps defined on opposite sides of the central vane as it moves away from or towards a respective lateral vane, the enlarged gap and the space between the vane assembly and the main aerofoil following the direction of the curve towards the trailing edge of the lateral slot on the opposite side of the central vane thereby forming a slot for airflow.

The wingsail assembly preferably further comprises a control vane which is settable to cause the main aerofoil to adopt an angle of attack to the direction of the wind, and a linkage which inhibits movement of the slot-forming assembly away from a neutral position when the control vane is set to a neutral position.

According to a further aspect of the invention a wingsail assembly comprises a main symmetrical aerofoil which is freely rotatable about an upright axis, a control vane which is settable about an upright axis spaced from the axis of the main aerofoil to cause the main aerofoil to adopt an angle of attack to the direction of the wind, a pivoted aerodynamic slot-forming vane assembly which is rotatable in response to wind pressure to open and close respective slots, one on each side of the leading region of the main aerofoil, and a linkage which inhibits movement of the slot-forming vane assembly away from a neutral position when the control vane is set to a neutral position.

The linkage may comprise an actuating member which extends to the region of the slot-forming vane assembly and carries a peg which engages an hour-glass shaped cavity, the peg being disposed in a central narrow part of this cavity when the member is in a position for setting the control vane to a neutral position.

DETAILED DESCRIPTION OF PREFERRED EMBODIMENTS

Exemplary embodiment of the invention will now be described by reference to the drawings. In FIGS. 1 to 5, the wind should be considered as blowing "down the page", and the phrases "left of wind" and "right of wind" are used to define elements, areas or actions when looking into the wind, which in this description will be regarded as "up the page".

Figure 1:
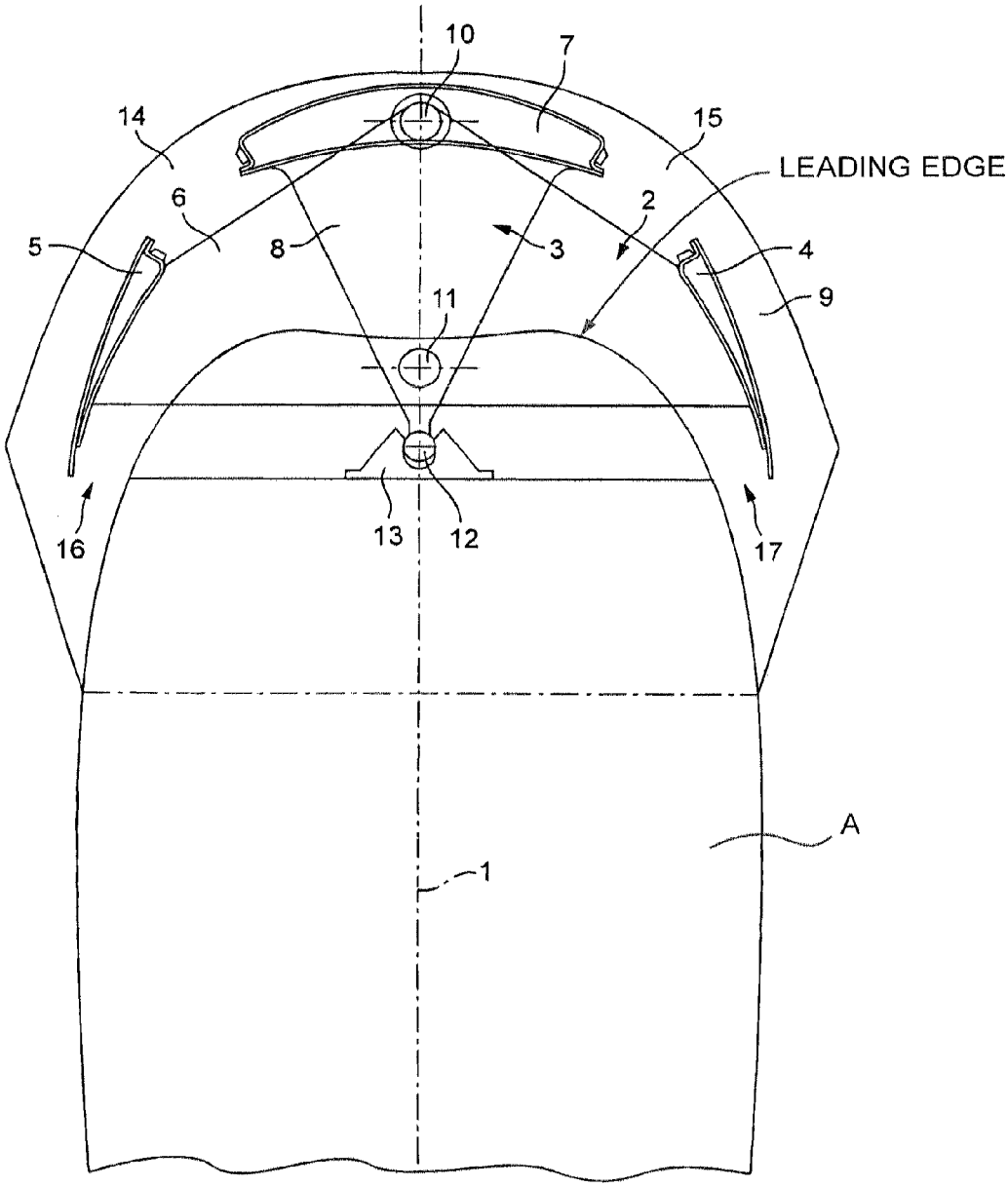
FIG. 1 illustrates schematically one embodiment of a multiple vane slot-forming assembly according to the invention.

FIG. 1 shows a horizontal cross section through the thrust wing according to this embodiment of the invention, shown with its three principal elements configured to be completely symmetrical about the plane of symmetry 1 of the main aerofoil A, so that if the thrust wing is aligned to the relative wind at zero angle of attack no cross-wind force will be reacted on to the vessel on which the wingsail is installed. Two further principal leading edge slot and slat elements are:—a twin vane assembly 2, consisting of two vanes 4 and 5 and two hinge plates 6, one at each end, and a single vane assembly 3, consisting of a single vane 7 and two hinge plates 8, one at each end of the main aerofoil. The aerofoil sections of both twin and single vanes are shaped to create, when deflected, a powerful slot effect which is by this embodiment of the invention reproducible on either tack in mirror image as described above.

The twin vane assembly 2 is pivoted to leading edge brackets 9 on the main aerofoil A at pivots 10 which form a common axis for the lateral vanes and which pivots are located in the plane of symmetry 1 of the main aerofoil A. The single vane assembly 3 is pivoted to the hinge plates 6 of the twin vane assembly 2 at pivots 11, and extensions of the hinge plates 8 carry hinge pins 12 which are constrained to lie in the plane of symmetry 1 of the main aerofoil A by slot brackets 13, whose center lines lie on and are parallel to the plane of symmetry 1 of the main aerofoil A.

In this symmetrical or neutral configuration there are four gaps, 14, 15, 16 and 17, through which the air flow (thought of as coming "down the page") may pass. In the 'neutral' configuration shown in FIG. 1 the airflow will pass symmetrically in through gap 14 and out through gap 16, and in through gap 15 and out through gap 17, so that symmetry will be maintained and therefore no cross-wind force will be developed. In the thrusting configuration on port or starboard tack, however, two of these gaps will be closed and the remaining two can form the inlet duct of a powerful leading edge slot and slat arrangement, as detailed below.

Figure 2:
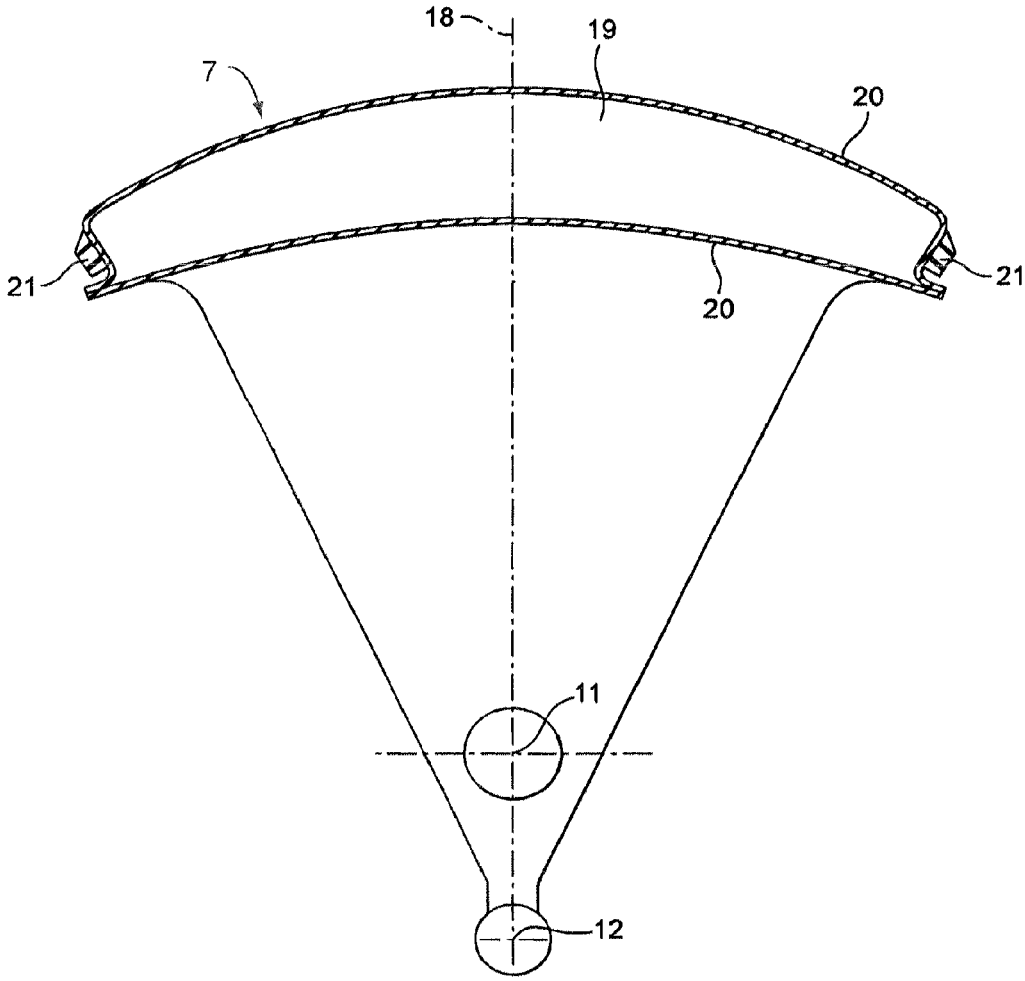
FIG. 2 illustrates schematically a central vane of the aforementioned embodiment.

FIG. 2 shows a section through the single vane assembly 3, showing the pivots 11 at which the unit is pivoted to the twin vane assembly 2, and the hinge pins 12 which are maintained accurately on the plane of symmetry 1 of the main aerofoil A by the slot brackets 13 shown in FIG. 1. Both pivots lie in the plane of symmetry of the assembly indicated by 18 in FIG. 2. In a possible method of construction according to this embodiment, the vane element 7 may be made of two skins of reinforced plastic, as indicated at 20, over a foam or other lightweight core 19. Resilient foam rubber or plastic sealing strips 21 may be installed to close the gap between assemblies 2 and 3 when the thrust wing is set to provide thrust.

Figure 3:
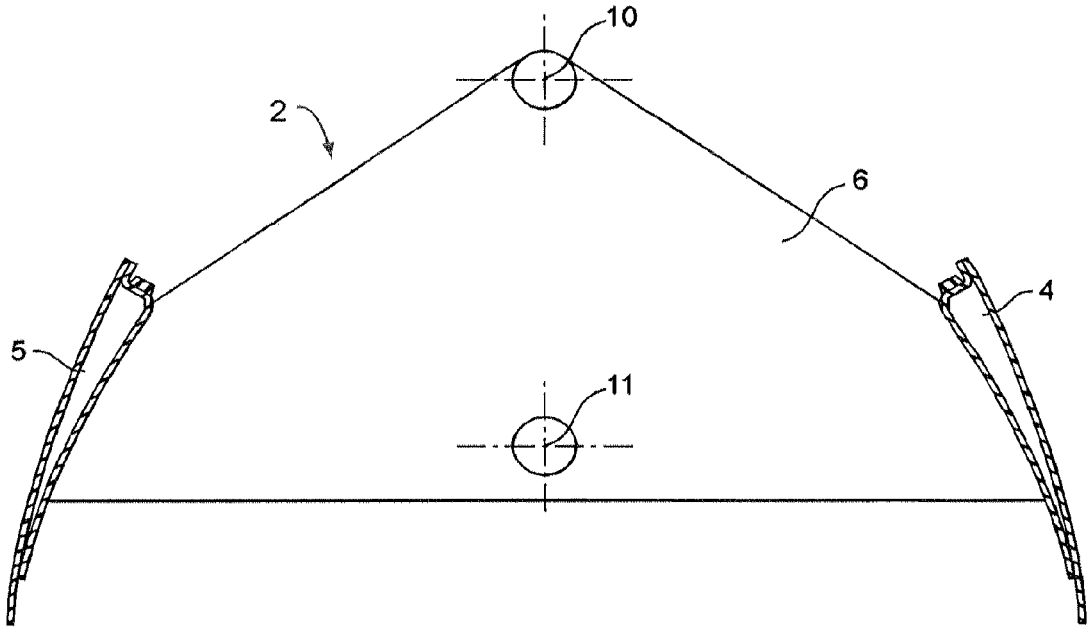
FIG. 3 illustrates schematically two lateral vanes of the aforementioned embodiment.

FIG. 3 shows a section through the twin vane assembly 2, showing the pivots 10 at which the assembly is pivoted to the upstream extension plates 9 mounted on the main aerofoil, and the pivots 11 at which the twin vane assembly carries the single vane assembly 3. The vanes 4 and 5 may, as indicated for the single vane 7, be made from two skins of reinforced plastic over a foam or other lightweight core, connected by the hinge plates 6. Resilient foam rubber or plastic sealing strips, as in the case of the single vane assembly 3, may be installed to close the gap between vane assemblies 2 and 3 when the thrust wing is set to provide thrust.

Figure 4:
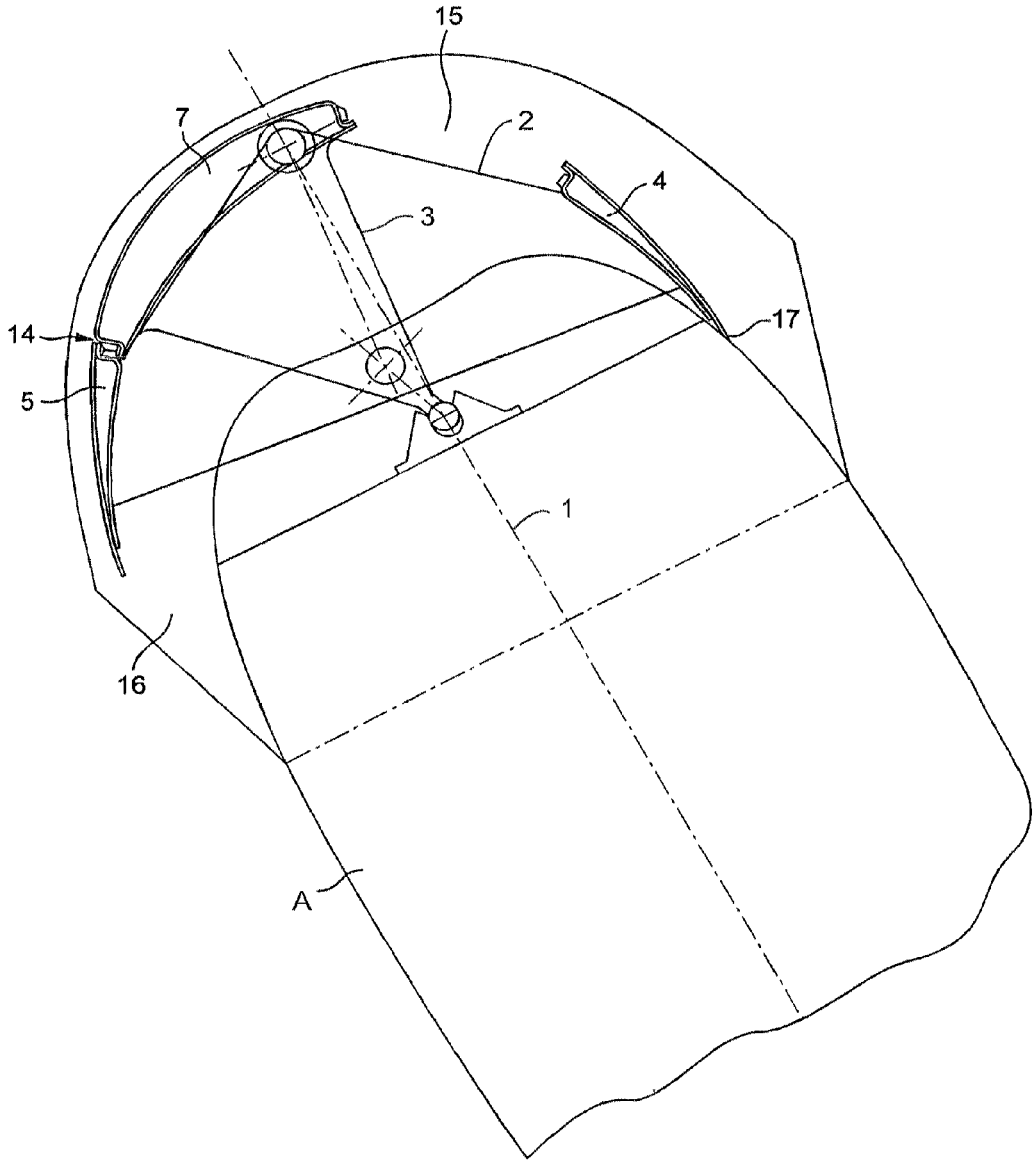
FIG. 4 illustrates the embodiment shown in FIG. 1 wherein the main aerofoil is at an acute angle to the direction of the wind.

FIG. 4 shows a horizontal cross section through the wingsail according to this embodiment, where the wingsail has been re-configured to thrust "left of wind". The main wing element 1 has been angled anticlockwise by the wingsail control system (not shown and not forming part of this invention) and the freely pivoted twin vane assembly 2 has been blown across, rotating in a clockwise direction until the right of wind vane 4 contacts the main aerofoil A. It may be noted that as the twin vane assembly 2 swings "left of wind" relative to the main aerofoil A, the single vane assembly 3 has been caused to swing in the opposite rotational direction so as to complete a slat and slot arrangement, closing off the gaps 14 and 17 shown in FIG. 1, while increasing the cross-sectional area of the gaps 15 and 16, as set out in more detail below.

The control system of the wingsail (not shown in this Figure), which may comprise an upright aerofoil of which the angular position may be adjusted, mounted on a boom or booms extending aft of the main aerofoil, has turned the main aerofoil A of the wingsail counter-clockwise from the symmetrical arrangement shown in FIG. 3 to create an "angle of attack". The wind, then blowing on the right of wind vane 4 of the twin vane assembly 2, has turned it clockwise (relative to the main aerofoil A) until the right of wind vane 4 closes the gap 17 on the right of wind surface of the main aerofoil A.

This rotation of the twin vane assembly 2 opens further the gap 16 between the left of wind vane 5 and the left of wind surface of the main aerofoil A, the wing and vane profiles being carefully shaped to form a convergent duct.

Simultaneously, the lever extension 8, its pivot pin 12 constrained to remain in the plane of symmetry of the main aerofoil A, causes the single vane assembly 3 to rotate counter-clockwise so as to open further the gap 15 and to close off the gap 17 between the vane 4 and the main aerofoil A.

The air flow passing in through the gap 15 and out through the gap 16 will augment the air flow on the left of wind side of the wing thrust unit, enabling it to maintain progressively increasing thrust levels up to a significantly greater angle of attack before stalling than a typical plain aerofoil, increasing the thrust obtained left of wind accordingly.

Figure 5:
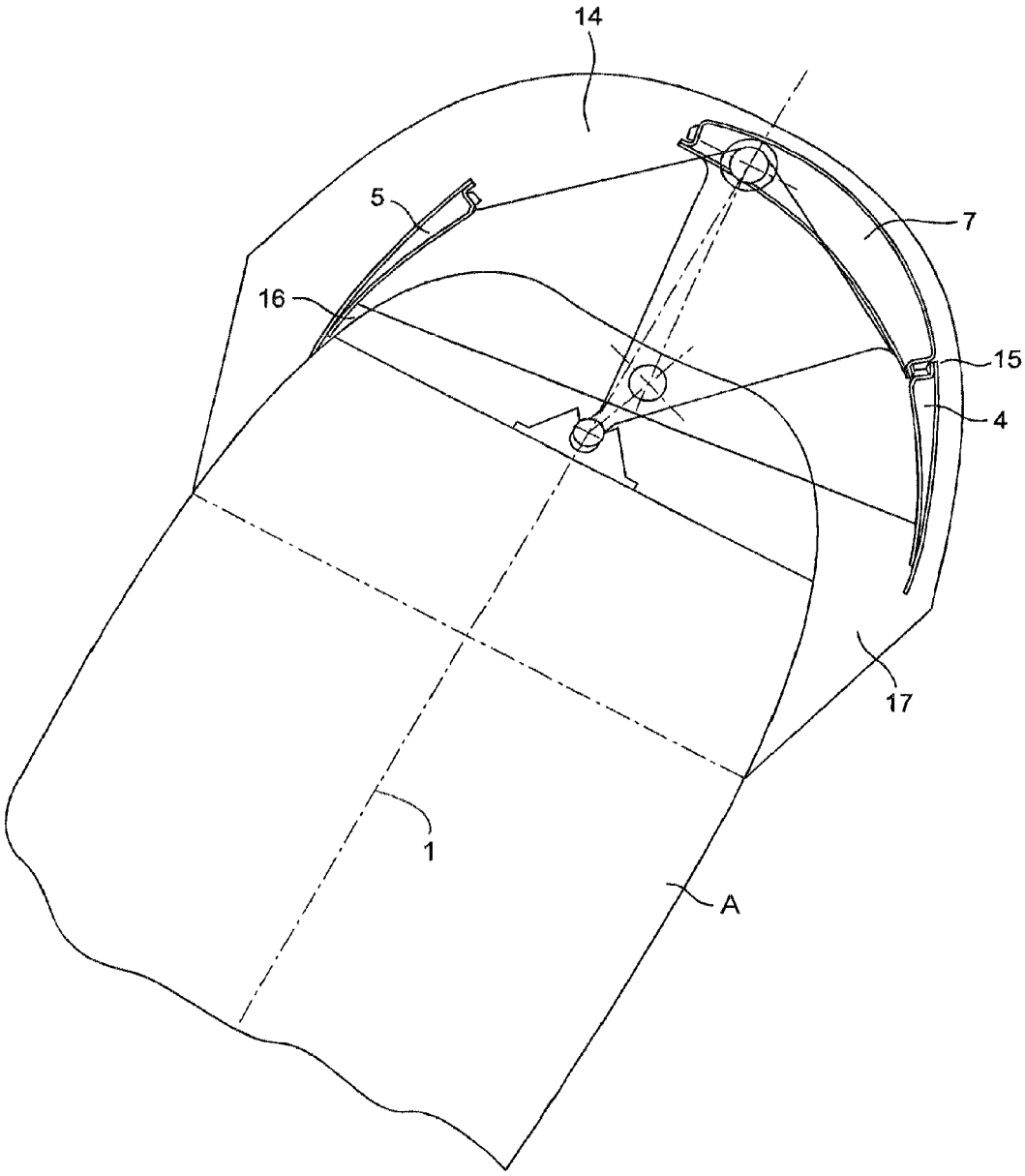
FIG. 5 illustrates the embodiment shown in FIG. 1 wherein the main aerofoil is at an opposite acute angle to the direction of the wind.

FIG. 5 shows a horizontal cross section through the wingsail according to this embodiment, shown re-configured to thrust "right of wind". It may be observed that the elements of the embodiment have now made an exact mirror image of the arrangement shown in FIG. 4, for thrust left of wind.

In the embodiment described in the foregoing, no control is applied to the slot-forming vane assembly, the wind pressure pushing the twin vane assembly (2 in FIG. 1) across to one side or the other, and positioning the single vane assembly (3 in FIG. 1) so as to form a slot for one side or other of the main aerofoil.

A further development is intended to avoid, when the device is in a neutral configuration, possible instability which may result from the twin vane assembly 2 blowing from left to right of its desired position symmetrically disposed about the plane of symmetry 1 of the wing. In the embodiment now to be described with reference to FIGS. 6 to 12, such instability is prevented by a mechanical interlock linkage incorporated in the operating system for the control vane disposed upstream or downstream of the main aerofoil A.

Figure 6:
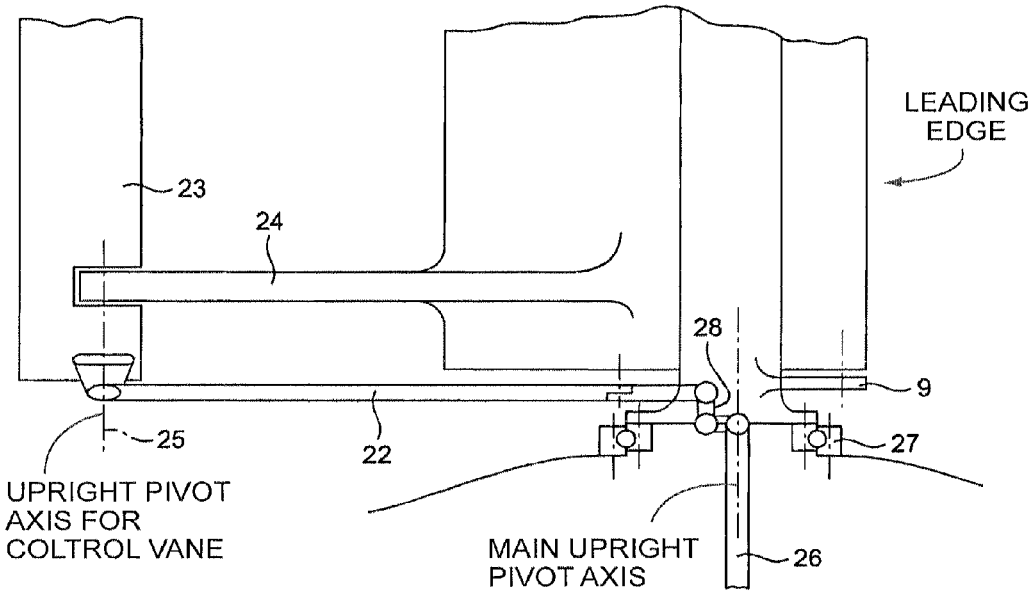
FIG. 6 is a schematic side view of a vane assembly according to an exemplary embodiment of the invention.

FIG. 6 shows a side elevation showing the base or root region of a vane assembly for example as described above and including a control vane 23 which is employed to adjust the angle of attack of the main aerofoil relative to the wind. An actuating member constituted by a rod 22 is shown acting on the symmetrical section control vane 23 which may in general be positioned upstream or downstream of the main aerofoil A but in the embodiment shown is downstream of the main aerofoil A. A bracket extends laterally from the control vane near the base thereof and the rod 22 is pivoted to this bracket so that to and fro movement of the rod alters the angle of the control vane about its upright pivot axis 25.

Such a control vane 23 may be mounted on a boom or booms 24 projecting downstream from the main aerofoil A to provide a vertical axis pivot or pivots 25 for the control vane, which lies or lie in the plane of symmetry 1 of the main aerofoil A. The pivot or pivots also lie in the plane of symmetry of the symmetrical section control vane 23. The rod 22 and thereby the vane 23 may be actuated by a vertical rod 26, set generally coaxial with the main support bearing 27, and connected to the rod 22 by a bell crank 28. Any adverse effect of the rotational movement of the wingsail on its bearing 27 may be eliminated by the incorporation of a swivel in the rod 26. Other arrangements for operating the rod 22, such as an electric or hydraulic actuator, with or without electronic computer involvement, may be provided within the scope of this embodiment.

In the embodiment shown in FIG. 6 the rod 22 is moved in an upstream/downstream direction to operate the control vane; and there is no linkage between the operation of the control vane and the slot-forming assembly.

Figure 7:
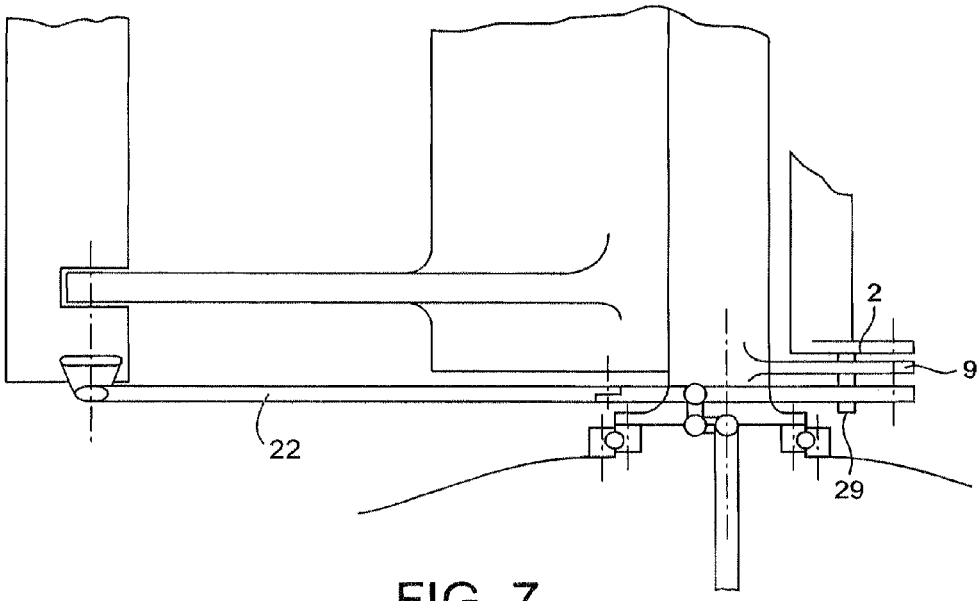
FIG. 7 is a schematic side view of a vane assembly according to an exemplary embodiment of the invention and including a mechanical interlock.

In the embodiment shown in FIG. 7, the rod 22 is extended upstream until its upstream end is at or somewhat upstream of the upstream elements of the slot-forming assembly. A peg 29 is fixed to the lower end plate of the twin vane assembly 2 in its plane of symmetry projecting downwards from the twin vane assembly 3 and passing through a clearance aperture in the lower support bracket 9. This peg 29 engages with a cavity in the upstream extension of rod 22 as shown in FIG. 8.

Figure 8:
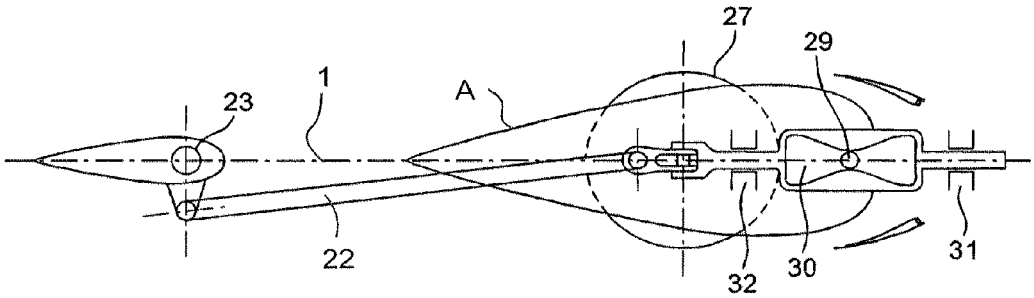
FIGS. 8 to 12 are views illustrating the operation of an exemplary embodiment including the interlock shown in FIG. 7.

FIG. 8 shows a plan view of this embodiment. The single vane assembly 3 has been omitted to show the other parts more clearly. The peg 29 runs in an hourglass-shaped cavity 30 in the upstream extension of rod 22, which cavity 30 has a neck which is a close fit on the peg 29 near the neutral position, where the rod 22 is holding the control vane and the slot assembly in the plane of symmetry 1 of the main aerofoil A.

Longitudinal guides 31, 32 may be incorporated to assist the maintenance of the rod 22 in the plane of symmetry of the main aerofoil A. A pivot may be incorporated in the linkage to the downwind tail vane 23 as shown to allow for angular movement of the tail 23 about its vertical axis 25.

To provide thrust to the left or right of the wind the rod 22 is moved upstream or downstream, which action rotates the control vane 23 to an angle of attack. The resulting aerodynamic force on the control vane rotates the main wing on its free bearing 27 to its own angle of attack. This actuates the slot-forming vane assembly as described with reference to FIG. 4 or 5.

Figure 9:
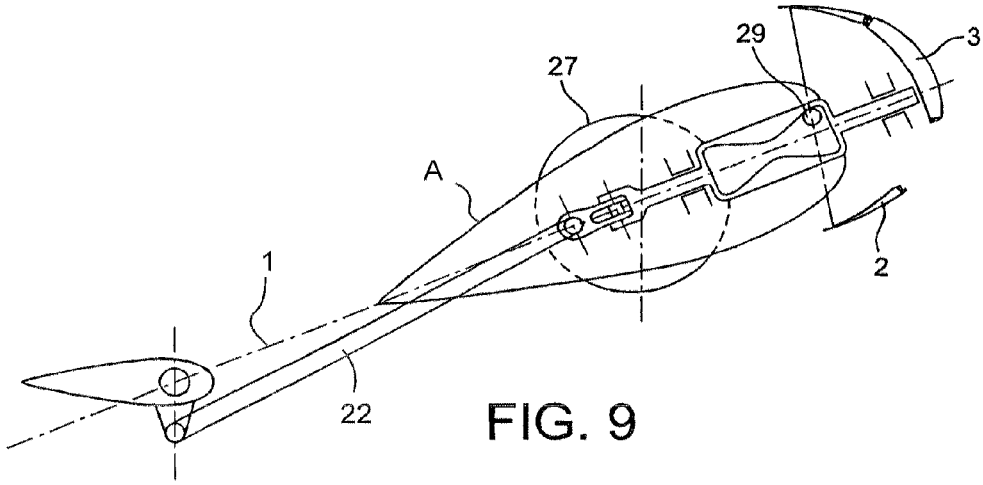

FIG. 9 shows the setting for thrust left of wind. The single vane assembly 3 is now shown. To permit the actuation of the slot-forming vane assembly the hourglass shaped cavity 30 is flared upstream and downstream of the neutral position as shown, providing lateral freedom for the peg 29.

When neutral is reselected the rod 22 returns to the neutral position, the angled faces 34 of the flared extensions upstream or downstream of the hourglass shaped cavity 30 act as a cam to "collect" the peg 29 and ensure that the elements of the slot-forming vane assembly are constrained to lie symmetrically about the plane of symmetry 1 of the main aerofoil A.

Figure 10:
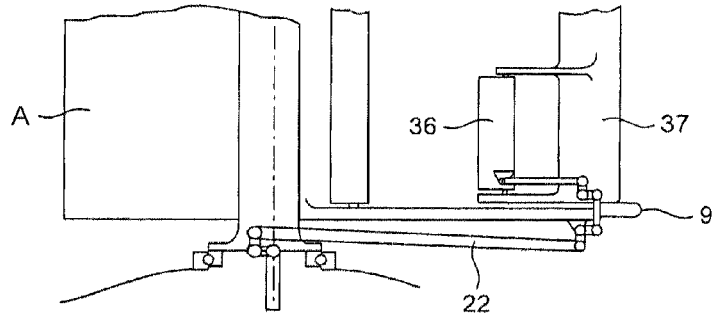

The control vane has been shown in FIGS. 7, 8 and 9 as a downstream tail vane 23. If the wingsail thrust unit is, alternatively, configured with an upstream control vane 37, the rod 22, which is now an upstream extension of the member defining the cavity 30, instead of acting directly on the control vane, may communicate with the control vane via a twin bell crank and swivel arrangement 40, as shown in FIG. 10. A tail vane 36 is mounted to the trailing edge of the upstream control vane 37, which in this case will be mounted on its own freely pivoting vertical axis bearings 38. The upper bell crank of the assembly 40 is linked to the tail vane 36 by a rod 39.

Figure 11:
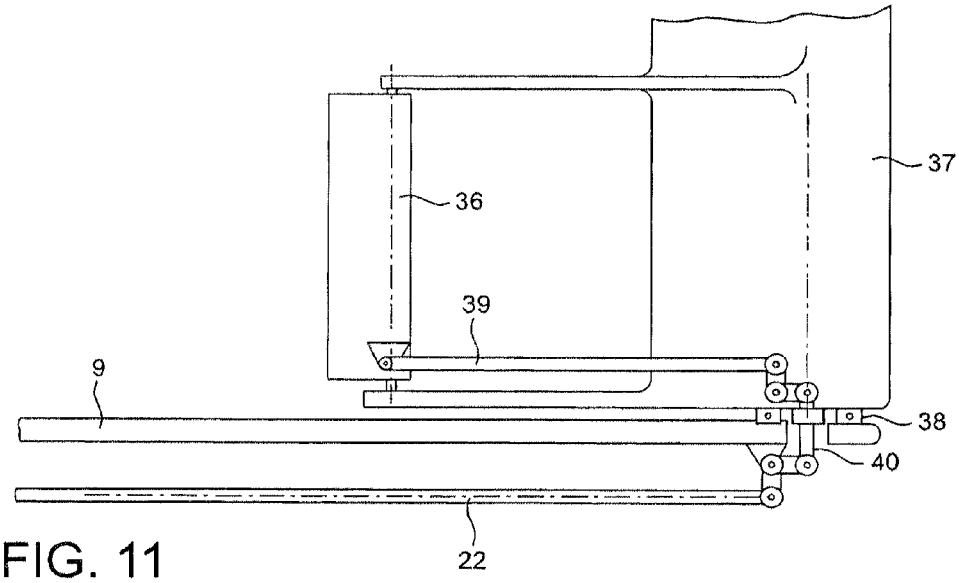
Figure 12:
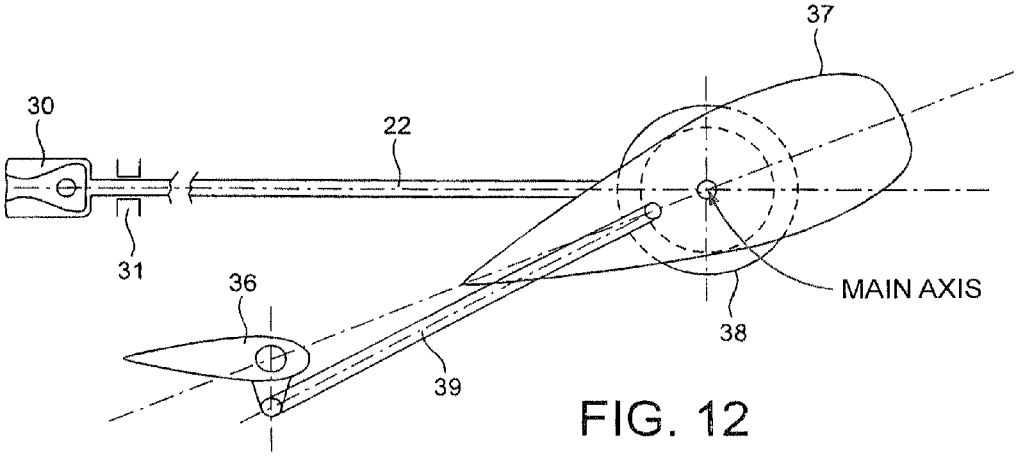

FIG. 11 shows the arrangement at the base of the control vane to a larger scale for clarity. FIG. 12 is a plan view which shows how, in such a configuration, thrust is again provided by moving rod 22 upstream or downstream, but now setting the tail vane 36 to an angle of attack which will rotate the upstream control vane 37, in turn rotating the main aerofoil A to an angle of attack. The neck of cavity 30 having released the peg 29 to permit lateral movement, the slot-forming vane assembly is able to configure, and thrust will be developed once the rotational aerodynamic force developed by the vane 37 has set the main aerofoil A to the appropriate angle of attack.

I claim:

1. A wingsail assembly comprising:

a main aerofoil having a leading edge;

a slot-forming vane assembly pivotally mounted forwardly of the leading edge of said main aerofoil, the vane assembly comprising a pair of first and second lateral vanes, positioned on opposite sides of the leading edge of said main aerofoil, and a central vane positioned between said lateral vanes and forwardly of said leading edge of the aerofoil; wherein said lateral vanes are disposed to define a first gap between said first lateral vane and said main aerofoil, a second gap between said second lateral vane and said main aerofoil, a third gap between said first lateral vane and said central vane and a fourth gap between said second lateral vane and said central vane; and wherein when said main aerofoil presents an angle of attack with respect to the wind, the pressure of the wind can move the vanes so whichever one of said lateral vanes is the leeward lateral vane is moved away from the main aerofoil, thereby enlarging the respective one of said first and second gaps with respect to the main aerofoil, and the central vane can move towards said leeward lateral vane to close the respective one of said third and fourth gaps and to enlarge that other one of the third and fourth gaps that is between said central vane and the windward lateral vane.

2. The wingsail assembly of claim 1 and including a carrier for said lateral vanes, said carrier having a pivot axis spaced from and fixed parallel relative to a rotary axis of the main aerofoil, said carrier defining a pivot axis for said central vane and said central vane having a pivot connection with the main aerofoil.

3. A wingsail assembly comprising:

a main aerofoil rotatable about an upright axis;

a slot-forming vane assembly, the vane assembly comprising:

a pair of lateral vanes and a central vane disposed along a curve spaced from and extending at least part way around a leading edge of the main aerofoil, said lateral vanes each defining a respective one of first and second gaps between the respective lateral vane and said central vane; wherein said central vane is movable along said curve with respect to the lateral vanes to correspondingly enlarge one of said first and second gaps and to decrease the other of said first and second gaps, the gap which is thus enlarged on one side of the central vane and a space between said vane assembly and said main aerofoil following the direction of said curve towards a trailing edge of the lateral vane on the opposite side of the central vane, thereby forming a slot for airflow.

4. The wingsail assembly of claim 3 and further comprising a control vane which is settable to cause the main aerofoil to adopt an angle of attack to the direction of the wind, and a linkage for inhibiting movement of the slot-forming assembly away from a neutral position when the control vane is set to a neutral position.

5. A wingsail assembly comprising:

a main symmetrical aerofoil which is freely rotatable about a main upright axis;

a control vane which is settable about an upright axis spaced from said axis of the main aerofoil to cause said main aerofoil to adopt an angle of attack to the direction of the wind;

a pivoted aerodynamic slot-forming vane assembly which is rotatable in response to wind pressure to open and close air passage slots, at least one said slot being disposed on each side of a leading region of said main aerofoil; and a linkage for inhibiting movement of the slot-forming vane assembly away from a neutral position when said control vane is set to a neutral position.

6. The wingsail assembly of claim 5 wherein the linkage comprises an actuating member which extends to a region of the slot-forming vane assembly and carries a peg which engages an hour-glass shaped cavity, said peg being disposed in a central narrow part of this cavity when said actuating member is in a position for setting the control vane to a neutral position.

7. The wingsail assembly of claim 5 wherein said slot-forming vane assembly comprises a central vane which is flanked by two lateral vanes which rotate about a common axis in response to wind pressure and said slots are formed between said central vane and said lateral vanes.

8. The wingsail assembly of claim 7 wherein said lateral vanes are disposed such that the one which forms a slot that is increased by movement of the slot-forming vane assembly closes a downstream gap between itself and said main aerofoil.

9. The wingsail assembly of claim 7 wherein said lateral vanes are mounted on a carrier which has a pivot axis spaced from and fixed parallel relative to a rotary axis of said main aerofoil, said carrier defining a pivot axis for said central vane and said central vane having a pivot connection with said main aerofoil, whereby wind pressure on said lateral vanes can rotate them in one direction and consequently cause rotation of said central vane in an opposite direction.

10. The wingsail assembly of claim 5 wherein said actuating member is coupled directly to said control vane.

11. The wingsail assembly of claim 5 in which the actuating member acts on a tail vane mounted on the control vane which is settable to control the angle of attack of the control vane.

* * * * *